United States Patent [19]

Scheurer et al.

[11] Patent Number: 4,642,060

[45] Date of Patent: Feb. 10, 1987

[54] CAM LOCKED SLIDEABLE FOOT BINDER

[75] Inventors: Robert S. Scheurer, P.O. Box 539; Kendal Hancock, both of Wichita Falls, Tex. 76307

[73] Assignee: Robert S. Scheurer, Wichita Falls, Tex.

[21] Appl. No.: 729,126

[22] Filed: May 1, 1985

[51] Int. Cl.[4] ..... A63C 15/06

[52] U.S. Cl. ..... 441/70; 441/68

[58] Field of Search ..... 441/68, 70; 280/11.31–11.34, 611, 616, 618, 623, 625, 627–634

[56] References Cited

U.S. PATENT DOCUMENTS

| | | | |
|---|---|---|---|
| 2,664,578 | 1/1954 | Clinedinst | 441/70 |
| 3,604,032 | 9/1971 | Kiefer | 441/70 |
| 3,703,013 | 11/1972 | Leach | 441/70 |
| 4,494,939 | 1/1985 | Calapp et al. | 441/70 |

*Primary Examiner*—Galen Barefoot
*Assistant Examiner*—Edwin L. Swinehart
*Attorney, Agent, or Firm*—James C. Wray

[57] ABSTRACT

A flexible foot binder is held in a slideable assembly which has upward facing detents along opposite sides. Inward opening slideways have over-the-center eccentric cam locks mounted on transverse pins. The cams engage the detents to press the slide assembly downward on the ski and to prevent motion of the slideable assembly.

9 Claims, 21 Drawing Figures

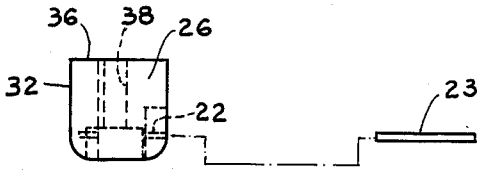
FIG. 5A
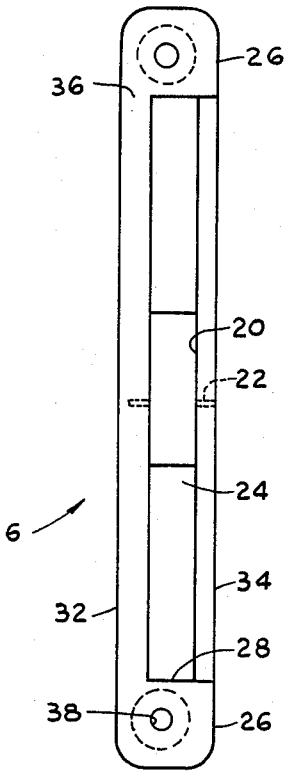
FIG. 5
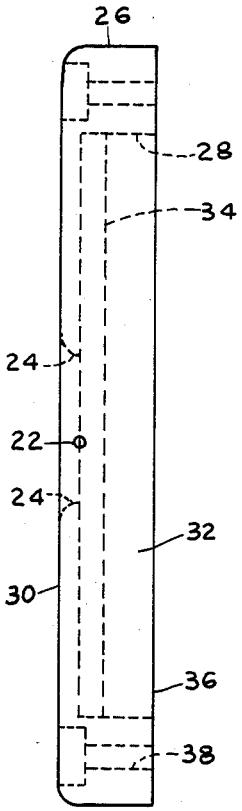
FIG. 6
FIG. 3
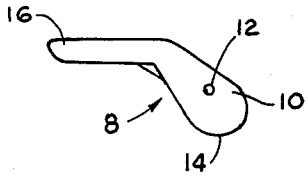
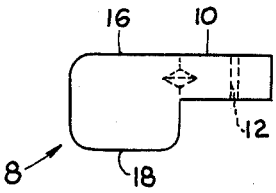
FIG. 4
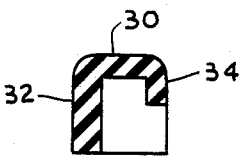
FIG. 7

CAM LOCKED SLIDEABLE FOOT BINDER

BACKGROUND OF THE INVENTION

This invention relates to slideable and adjustable foot bindings particularly for use with water skis.

Typically, water ski bindings have two portions, usually the front portion is anchored to the ski and the rearward portion is slideable rearward to open the binding to permit withdrawal or insertion of a foot in the forward toe and instep holding portion. The rear heel binding portion is then slid forward and is locked in position on the ski. Typical locks for sliding binders are posts fixed to the ski and extending through slots in the sliding assembly. Complementary fasteners on the posts secure the binders in position on the skis. Problems remain with the use of such post-type locks in that the cantilevered posts do not provide rigid guides until fasteners are tightened on the posts. The long cantilevered posts may permit misalignment of the sliding elements or the tops of the posts on which the fasteners are mounted may tend to move out of position and to align with the sliding element rather than requiring the sliding element to align with the fasteners.

SUMMARY OF THE INVENTION

The present invention provides a quick method of fastening a sliding foot binder piece on devices such as particularly water skis.

In the present invention the locking assemblies act as guides to align and control the travel of the sliding assemblies. The locking members lock the sliding assemblies in predetermined fixed positions with no positional misaligning of the sliding assemblies.

In preferred forms the locking assemblies also ensure the grip on the edges of the flexible foot covering.

A preferred adjustable heel binder for water skis has a flexible forward opening heel shaped rubber-like cover having an outward extending peripheral flange around its lower edge, a forward opening generally U-shaped retainer cap for overlying the peripheral flange, a sliding base plate member for underlying the peripheral flange and fastener means for connecting the base plate through the peripheral flange to the cap member, thereby forming a sliding assembly of the base plate, cap member, flexible heel receiver and peripheral flange and the fastener means. Detent means connected to the assembly have upward facing sequential detents. Slide means are mounted along the detent means and mounting means connect the slide means to the ski. Holder means mounted in the slide means and eccentric cam means mounted on the holder means selectively engage and disengage the detents. Lever means connected to the cam move the cam means into and out of engagement with the detents. The sliding assembly is locked in place on the ski when the cam means are in engagement with the detent means.

In the preferred apparatus the detent means comprise lateral outward extensions on the base plate. The lateral outward extensions have upward facing detents.

Preferably, the slide means comprise first and second spaced slideways permanently mounted on the water ski at opposite sides of the slide assembly.

Preferred slideways have first and second end portions with inward oriented faces for abutting longitudinal end faces of the extensions, thereby defining limits of sliding of the extensions. The slideways comprise an upper element interconnecting the end portions, and the upper element has an opening for receiving the eccentric cam means.

The preferred slideway has a generally inverted J-shaped cross section, with the long outer wall and the end portions forming an inward opening enclosure and with a relatively short inner wall extending downward from the upper element for entrapping upward extensions of the detent and holding the sliding assembly captured between the slideways when the latter are mounted on the water ski.

Preferably the detent means comprises a laterally outward extension connected to the cap means.

In a preferred embodiment, adjustable water ski foot binder apparatus comprises a slideable assembly having flexible means for overlying a foot portion and mounting means for holding the flexible means and relatively fixed slideway means for at least partially overlying the mounting means. First locking means is connected to the slideway means for extending toward and away from the mounting means to lock the mounting means and slideable assembly in position on the ski.

The preferred locking means comprises an eccentric cam means connected to the slideway and lever means connected to the cam means for moving the cam means toward and away from the mounting means. Mounting pins are connected in the slideways in a direction transverse to a longitudinal direction of the ski and the cam means are mounted for rotation on the pin means. An upwardly facing detent means is on the mounting means, and the cam means is movable downward into the detent means and upward away from the detent means.

These and further and other objects and features of the invention are apparent in the disclosure which includes the above and ongoing specification with the claims and the drawings.

BRIEF DESCRIPTION OF THE DRAWINGS

FIGS. 3 and 4 are elevation and plan views of a preferred over-the-center eccentric cam and lever operator.

FIGS. 5 and 5A and 6 are elevations of one preferred guideway.

FIG. 7 is a cross-sectional detail of the guideway shown in FIGS. 5 and 6.

DETAILED DESCRIPTION OF THE DRAWINGS

Figure 1:
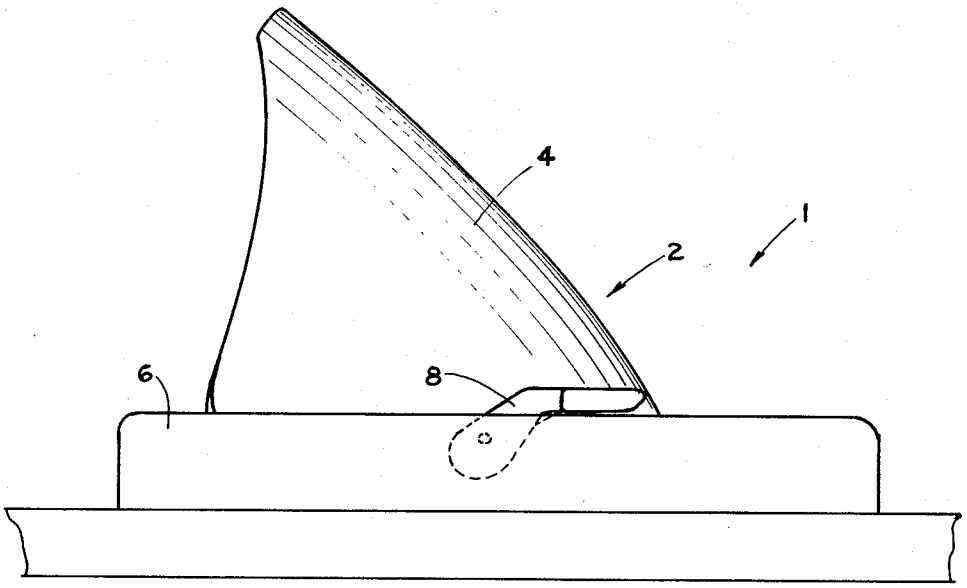
FIG. 1 is an elevation of a preferred binding of the present invention.
Figure 2:
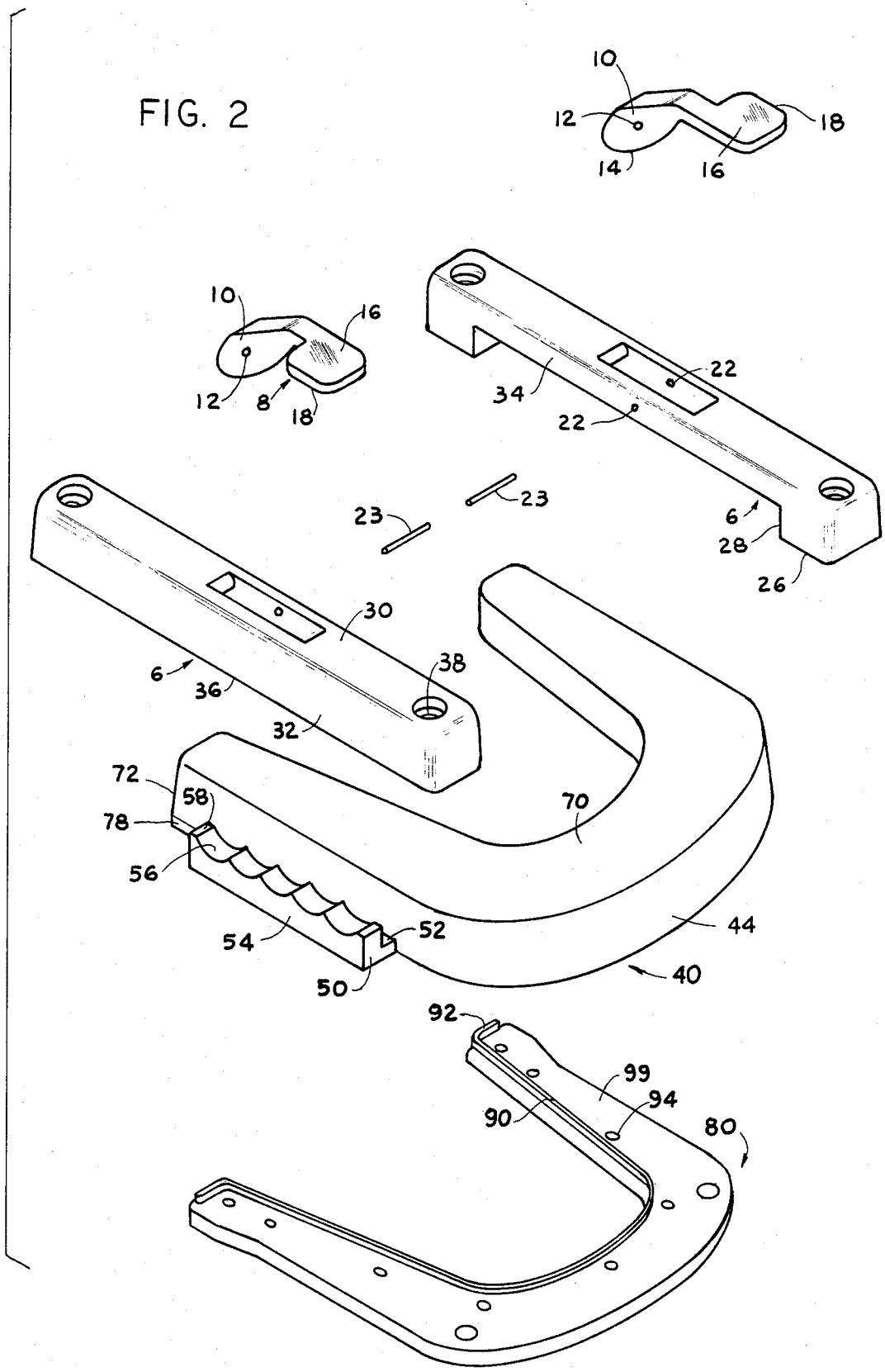
FIG. 2 is an exploded view of the invention.
Figure 11:
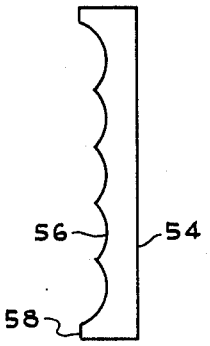
FIG. 11 is a side elevational detail of the lateral extensions of the cap shown in FIGS. 8, 9 and 10.

The slideable binder apparatus is generally indicated by the numeral 1. A slideable assembly 2, which includes a flexible foot covering 4, is mounted between parallel slideways 6. Locking devices 8 are mounted on the slideways 6 to lock slide assemblies 2 in predetermined positions.

A preferred embodiment of the locking device 8 is shown in FIGS. 3 and 4. A cam 10 is eccentrically mounted around a pin receiving hole 12. The lowermost part 14 of the cam is forward of the pin receiving hole so that when lever 16 is pressed downward, the cam effects an over-the-center lock. As shown in FIG. 4, lever 16 has a lateral projection 18 to aid in the lifting disengagement and the downward engagement of the cam 10.

The cam 10 is mounted in the opening 20 in the slideway 6, generally shown in the projections of FIGS. 5, 6 and the cross-sectional detail in FIG. 7. A pin receiving hole 22 communicates with the cam receiving opening 20 to receive a pin 23 extended through the hole 22 in the slideway 6 and through hole 12 in the cam. Alternatively, the cam may be held by external surface contact in an especially contoured opening which replaces opening 20. Edges 24 of the opening 20 are rounded to permit extended range of movement of the cam 10 and lever 16. Slideways 6 have end portions 26 with inward facing surfaces 28 which act as stops to restrict longitudinal travel of the slide assembly.

As shown in FIGS. 5, 5A, 6 and 7, the preferred slideway has a top 30 and a outer wall 32 and a relatively short inner wall 34. A bottom 36 of the outer wall 32 and the end portion 26 rests upon the ski. The slideway 6 is anchored to the ski by bolts which extend through countersunk holes 38.

Figure 13:
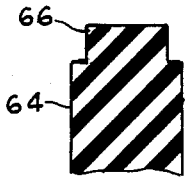
FIG. 13 is a detail of the end of the integral pin shown in FIG. 12.
Figure 12:
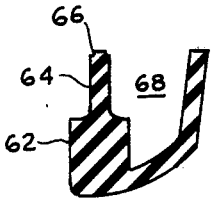
FIG. 12 is a cross-sectional detail of a cap taken along lines 12—12 of FIG. 8.

A major portion of the slide assembly 2 is the cap 40. As shown in FIGS. 8–12, cap 40 has generally a U shape. Cap 40 has a forward portion 42, a rearward portion 44 an inside edge 46 and an outer edge 48. Extensions 50 extend laterally from outer portions 48. Extensions 50 have an offset 52 which underlies inner wall 34 of the slideway. A detent portion 54 has plural adjacent detent grooves 56 and end stop portions 58 which abut inner walls 28 of the slideway at limits of motion of the sliding assembly. In a preferred embodiment the cap 40 is molded and an inner edge of the cap 60 which overlies and grips the peripheral flange area of the flexible foot covering 4 has reinforced sections 62 extending inward therefrom. In one form of the invention, fastener pins 64 extend downward from the reinforced sections 62. The fastener pins have a reduced section 66 at their tip, as best shown in FIGS. 12 and 13. The fastener pins 64 extend through holes in the peripheral flange of the foot cover 4 and lock the flange in place. Tips 66 are fused in place in the base plate which will be later described.

Alternatively, the pins 64 may be replaced by screws which extend upward through the base plate through the peripheral flange and into holes formed in reinforced portions 62.

Figure 8:
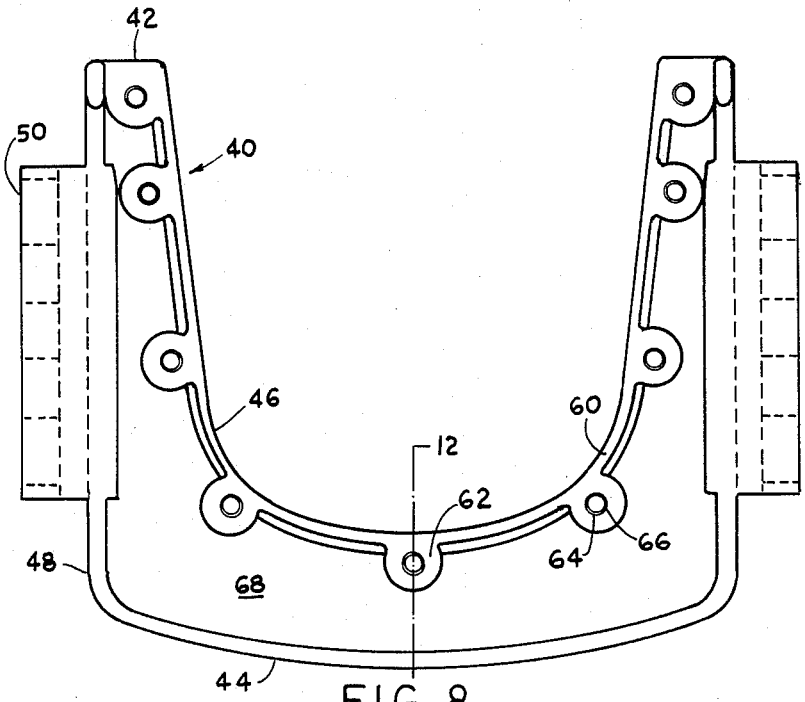
FIG. 8 is a bottom view of a preferred cap for holding a peripheral flange of a foot covering.
Figure 9:
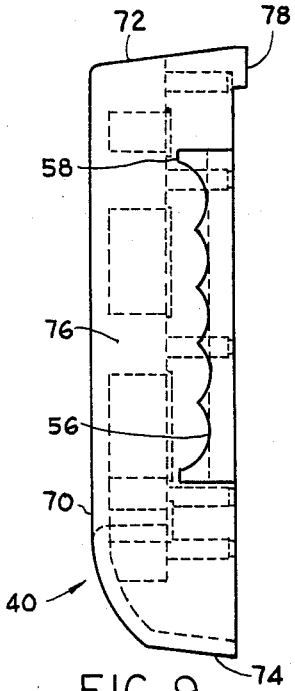
FIGS. 9 and 10 are side and end elevations of the cap shown in FIG. 8.
Figure 10:
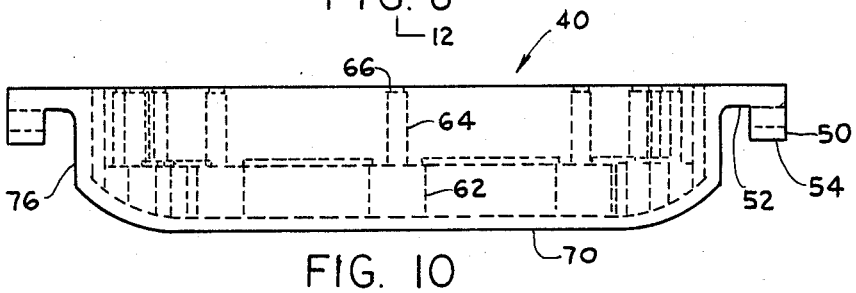

As shown in FIG. 8, a recessed area 68 is formed between the inner wall 46 and the outer wall 44.

Figure 15:
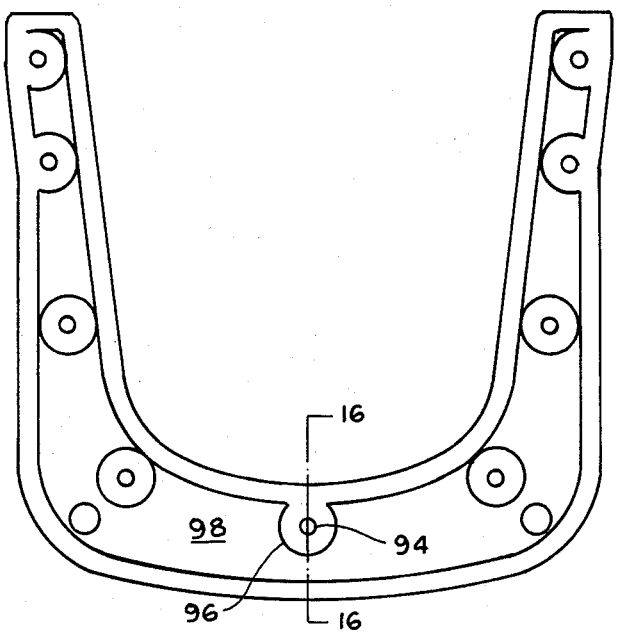
FIG. 14 is a plan view of the preferred base plate and FIG. 15 is a bottom view of the base plate shown in FIG. 14.
Figure 16:
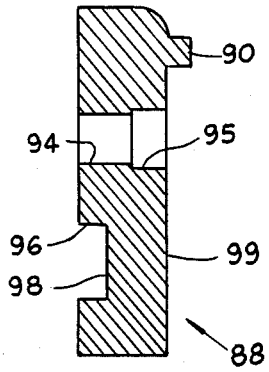
FIG. 16 is a cross-sectional detail of the base plate taken along lines 16—16 of FIG. 15.
Figure 14:
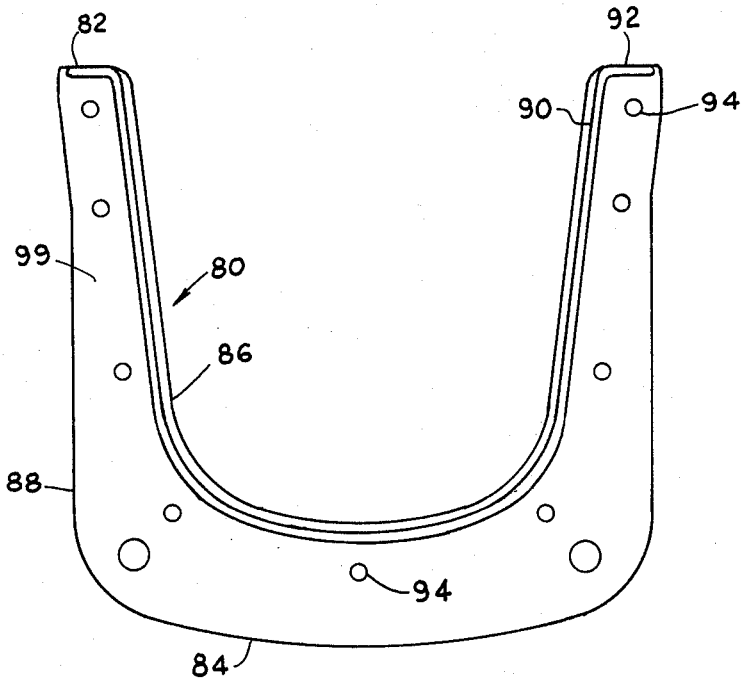

The cap 40 has a smooth outer surface with a rounded upper portion 70 and a sloping forward portion 72. The upper portion is rounded rearwardly into rearward wall 74 and is rounded outwardly into outer walls 76. Downward extending lugs 78 center the attached sliding plate 80, as shown in FIGS. 14–16. Sliding base plate 80 may be made to extend across the ski. Preferably plate 80 is made generally in a U shape with forward ends 82 and a rearward edge 84 with a rounded inner U-shaped wall 86 and an outer wall 88. A lip 90 extends upward from the rounded inner wall 86. The lip 90 has forward portions 92. The forward portions of outer wall 88 fit inside the lugs 78 on the cap portion 40. Holes 94 align with pins 64. Holes 94 are countersunk 95 to receive the extension 66 of the pins after the pins have been extended through the peripheral flange area of the foot cover 4. The pin projections 66 and the lower ends 64 are fused, bonded or welded to the holes 94 and the countersinks 95, respectively. In an alternate embodiment, countersinks are formed at the other end of holes 94 and flat head screws extend through holes 94 upward through the peripheral flange area and into the reinforced elements 62 of the cap 40. Preferably, such screws fit into tapped holes centered in reinforcements 62 or self thread into the material surrounding the holes. The holes 94, as seen in the bottom view FIG. 15, and the cross section, FIG. 16, are positioned in reinforced portions 96, leaving a recessed area 98 in the bottom of the plate 80. The upper surface 99 of plate 80 underlies the lower surface of the peripheral flange of the foot cover 4. The lip 90 assists in gripping the flange.

Another form of the present invention is shown in FIGS. 17–20.

Elements similar to the elements in FIGS. 1–16 are identified by similar numbers in the 100 series. The adjustable binder is generally indicated by the numeral 101 and 102 represents the sliding assembly which includes the flexible holder 104 for the foot portion. Guideway 106 holds lock 108 which has an eccentric cam 110 with a lower engaging surface 114 and a lever 116. The cam 108 is mounted in an opening 120 in an upper surface of the fixed guideway 106. A pin 123 extends between side walls 132 and 134 of the guideway 106. The peripheral edge portion 105 of the foot cover 104 is captured by pins 164 between cap 140 and sliding plate 180. A detent means 154 on the upper surface of the cap 140 has plural detents 156 between ends 158.

Figure 18:
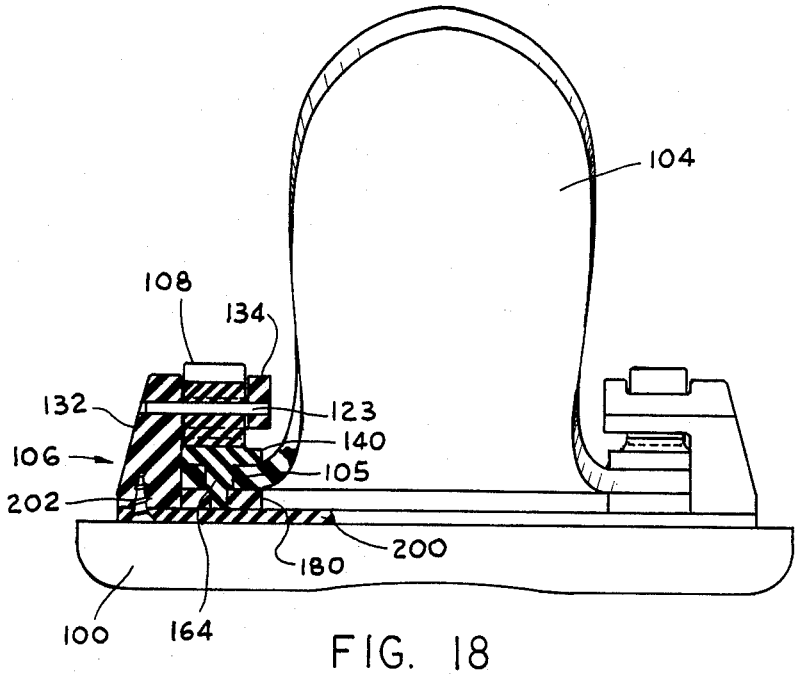
FIG. 18 is an end elevation, partially in section, of the binder shown in FIG. 17.
Figure 17:
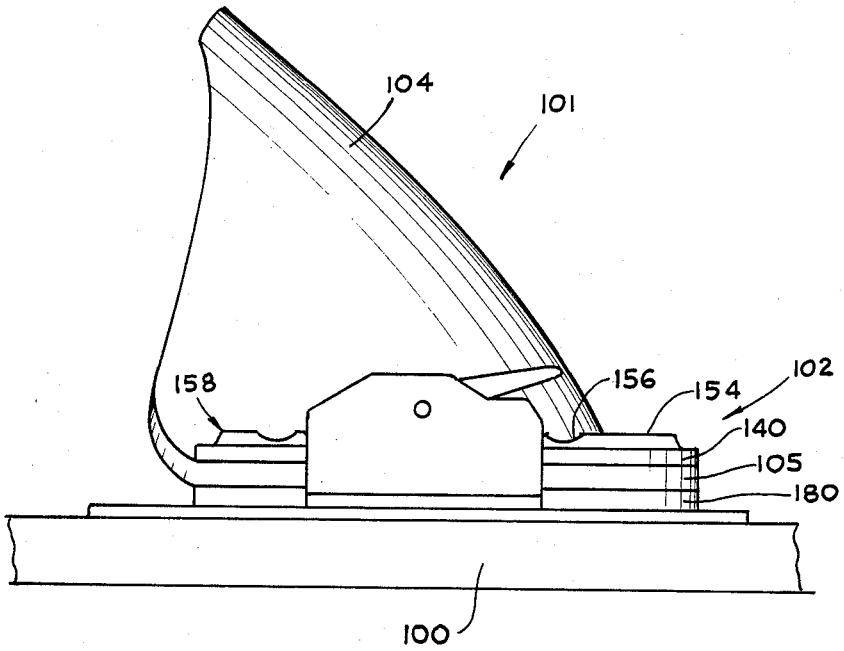
FIG. 17 is a side elevational view of an alternate adjustable binder.
Figure 19:
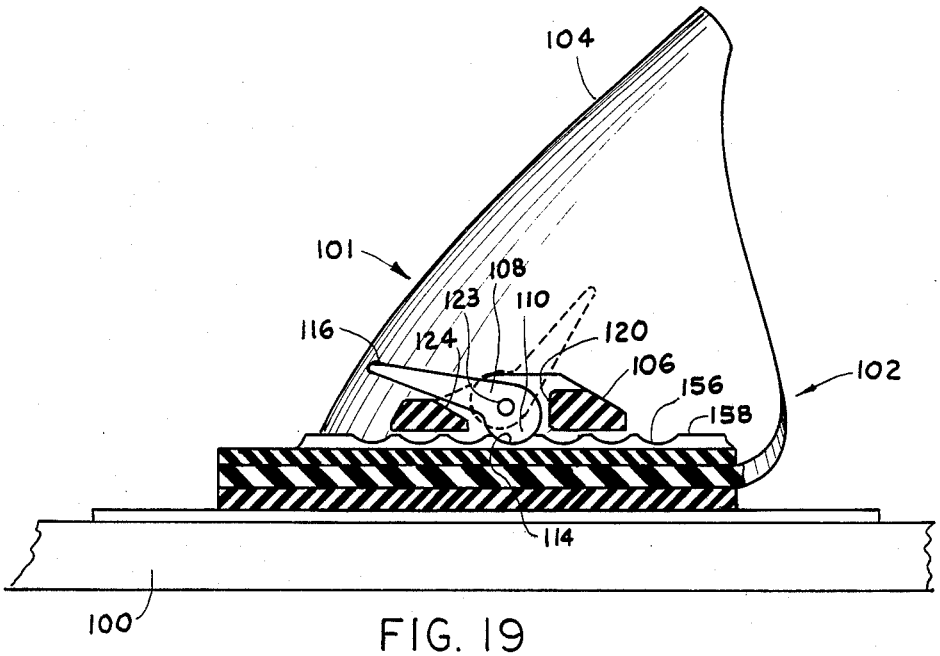
FIG. 19 is an elevational view, partially in section, of the binder shown in FIGS. 17 and 18.
Figure 20:
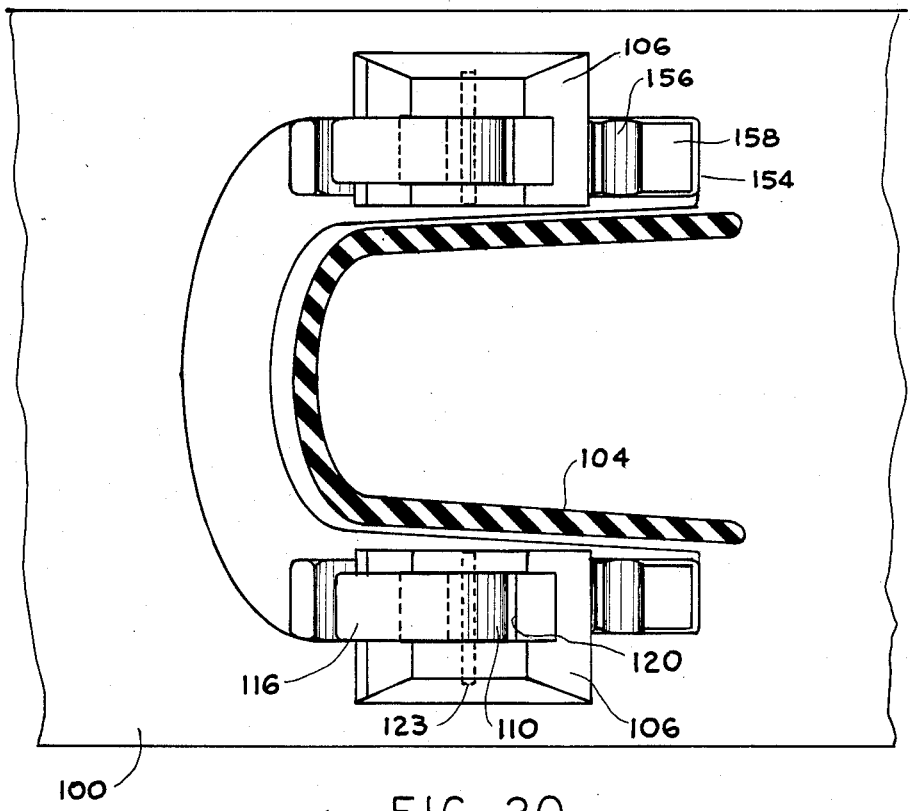
FIG. 20 is a plan view of the binder shown in FIGS. 17, 18 and 19.

The guideways 106 may be mounted on a bottom plate 200 by screws 202, as shown in FIG. 18. Plate 200 is in turn permanently attached to the ski 100. Alternatively, the guideways 106 may be attached directly to the skis, such as by screws which extend downward through the guideways into the ski.

While the drawings show heel binders, the same structural elements may be used for toe binders with fixed heel binders or duplicate structures may be used in slideable toe binders and slideable heel binders.

While the invention has been described with reference to specific embodiments, modifications and variations of the invention may be constructed without departing from the scope of the invention.

The scope of the invention is defined in the following claims.

What is claimed is:

1. An adjustable heel binder for water skis comprising a flexible forward opening heel shaped rubber-like cover having an outward extending peripheral flange around its lower edge, a forward opening generally U-shaped retainer cap member for overlying the peripheral flange, a sliding base plate member for underlying the peripheral flange and fastener means for connecting the base plate through the peripheral flange to the cap member, thereby forming a sliding assembly of the base plate, cap member, flexible heel receiver and peripheral flange and the fastener means, and detent means connected to the assembly and having upward facing sequential detents, slide means configured for mounting along the detent means and mounting means for connecting the slide means to the ski, holder means mounted in the slide means and eccentric cam means mounted on the holder means for selectively engaging and disengaging the detents and lever means connected to the cam means for moving the cam means into and out of engagement with the detents whereby the sliding assembly is locked in place on the ski when the cam means are in engagement with the detent means.

2. The apparatus of claim 1 wherein the detent means comprise lateral outward extensions on the base plate, the lateral outward extensions having upward facing detents.

3. The apparatus of claim 2 wherein the slide means comprise first and second spaced slideways permanently mounted on the water ski at opposite sides of the slide assembly.

4. The apparatus of claim 3 wherein the slideways have first and second end portions with inward oriented faces for abutting longitudinal end faces of the extensions, thereby defining limits of sliding of the extensions.

5. The apparatus of claim 4 wherein the slideways comprises an upper element interconnecting the end portions and wherein the upper element has an opening for receiving the eccentric cam means.

6. The apparatus of claim 5 wherein the slideway has a generally inverted J-shaped cross section, with the long outer wall and the end portions forming an inward opening enclosure and with a relatively short inner wall extending downward from the upper element for entrapping upward extensions of the detent and holding the sliding assembly captured between the slideways when the latter are mounted on the water ski.

7. The apparatus of claim 1 wherein the detent means comprises a laterally outward extension connected to the cap means.

8. Adjustable water ski foot binder apparatus comprising a slideable assembly having flexible means for overlying a foot portion and mounting means for holding the flexible means and further comprising relatively fixed slideway means for at least partially overlying the mounting means, first locking means connected to the slideway means for extending toward and away from the mounting means to lock the mounting means and slideable assembly in position on the ski, wherein the locking means comprising an eccentric cam means connected to the slideway and lever means connected to the cam means for moving the cam means toward and away from the mounting means, and further comprising an upwardly facing detent means on the mounting means and wherein the cam means is movable downward into the detent means and upward away from the detent means.

9. The apparatus of claim 8 further comprising mounting pin means connected in the slideways in a direction transverse to a longitudinal direction of the ski and wherein the cam means are mounted for rotation on the pin means.

* * * * *